United States Patent [19]

Calgaro et al.

[11] Patent Number: 4,588,374

[45] Date of Patent: May 13, 1986

[54] DEVICE FOR CONTROLLING THE FLOWRATE OF A LIQUEFIED-GAS LIGHTER

[75] Inventors: Honoré Calgaro; Claude Grossiord, both of Annecy, France

[73] Assignee: S. T. Dupont, Paris, France

[21] Appl. No.: 593,321

[22] Filed: Mar. 26, 1984

[30] Foreign Application Priority Data

Apr. 1, 1983 [FR] France ..... 83 05461

[51] Int. Cl.[4] ..... F23D 13/04

[52] U.S. Cl. ..... 431/344; 431/131; 431/150; 222/3

[58] Field of Search ..... 431/344, 131, 130, 150; 222/3; 251/205, 208, 120, 121; 138/45, 46, 43

[56] References Cited

U.S. PATENT DOCUMENTS

| | | | |
|---|---|---|---|
| 3,072,151 | 1/1963 | Quercia | 138/45 |
| 3,196,924 | 7/1965 | Kaminga | 431/344 |
| 4,157,891 | 6/1979 | Moriya | 431/344 |

FOREIGN PATENT DOCUMENTS

| | | | |
|---|---|---|---|
| 1632608 | 1/1967 | Fed. Rep. of Germany . | |
| 2812492 | 10/1978 | Fed. Rep. of Germany | 431/344 |
| 2277305 | 1/1976 | France | 431/344 |
| 2385988 | 3/1977 | France . | |

*Primary Examiner*—Samuel Scott
*Assistant Examiner*—Carl D. Price
*Attorney, Agent, or Firm*—John P. Morley

[57] ABSTRACT

This device is of the type having a permeable elastic disk (13) disposed in a circuit supplying the burner with gas and subjected to compression by two elements activated by the same control element, an annular compression element (17) and a central compression element (20). According to the invention, control element (31) is mounted to slide between two positions, a presetting position wherein it is coupled rotationally with annular compression element (17) and a setting position where it is decoupled therefrom.

6 Claims, 5 Drawing Figures

DEVICE FOR CONTROLLING THE FLOWRATE OF A LIQUEFIED-GAS LIGHTER

Figure 1:
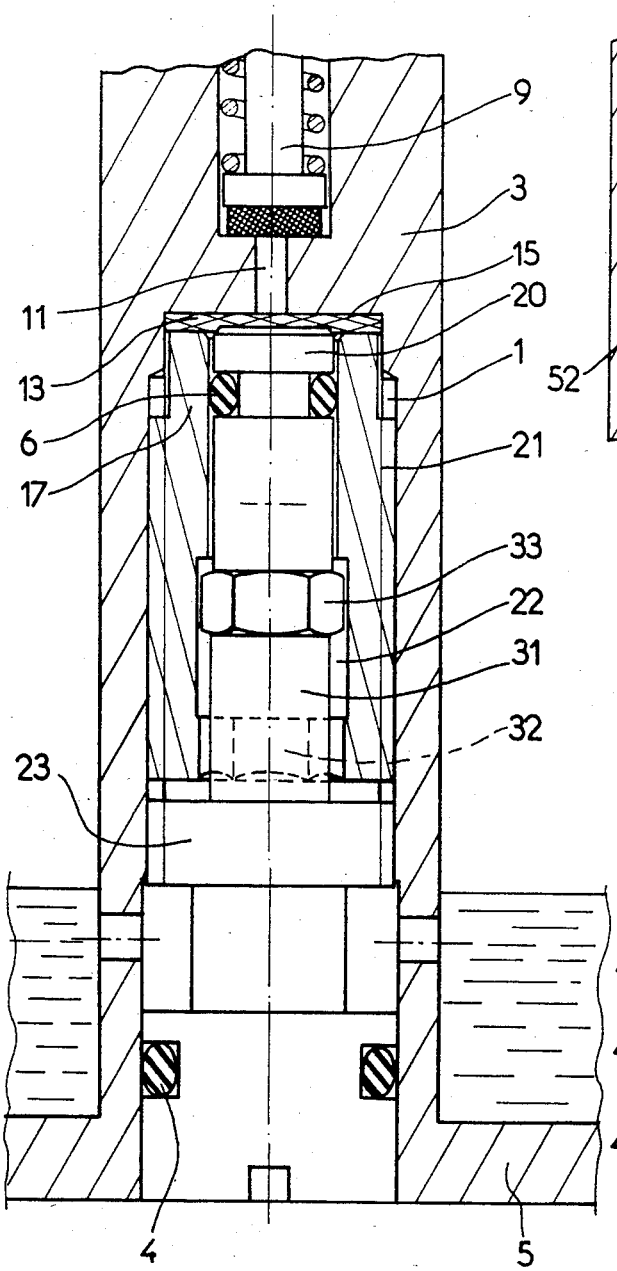

The present invention relates to a device for controlling the flowrate of a liquefied-gas lighter and, in particular, a device enabling the maximum height of the flame the lighter can produce to be adjusted to a given value.

Most devices for adjusting the flowrates of liquefied-gas lighters use a compressible element, which may or may not be traversed by the gas, which is compressed to a greater or lesser degree according to the desired gas flowrate. Some of these devices additionally have means of limiting the gas flowrate and hence the height of the flame supplied to a given maximum value.

These means usually consist of a presetting stage disposed in the gas flow path and causing it to undergo an additional pressure loss, this presetting stage being arranged in series with the normal setting stage.

It has been proposed that presetting and setting of the flame height of a lighter be accomplished by means of a single permeable pellet. Thus, setting devices are known wherein presetting is provided by annular compression of a permeable compressible disk by means of a first annular screw screwed into the body of the expander and setting is provided by central compression of the same disk by means of a second screw screwed into an internal thread of the first screw.

This type of device permits easy access to the presetting and setting means from the outside of the lighter and hence enables the maximum flame or operating flame height to be corrected without having to disassemble either the presetting system or the setting system.

However, a disadvantage inherent in this type of device resides in the fact that presetting and setting are not independent of each other, and that a modification in one is likely to cause a modification in the other. Indeed, because the presetting and setting screws are screwed into each other, they are linked rotationally by the friction between their common threads.

It has also been proposed that presetting be accomplished with the aid of an annular screw screwed into the body of the expander, and setting be accomplished with the aid of a second screw screwed upstream of the first, also in the body of the expander, part of which passes through the annular screw to compress the elastic disk. Although this type of device ensures full independence of the two compression screws from each other, it does not permit access to the screw exerting the annular compression, without previously disassembling the entire device.

The goal of the present invention is to remedy these disadvantages by proposing a flowrate setting device of the aforementioned type wherein the presetting system, namely setting the maximum flame height, and the system for setting the flame to the operating height are both independent of each other and activatable from the outside of the lighter, without disassembly and hence without loss of the settings.

For this purpose, the subject of the invention is a flowrate setting device of a liquefied-gas lighter, of the type having a permeable elastic disk, disposed in the circuit supplying gas to the burner and subjected to compression by two elements activated by a single control element, namely a first annular compression element screwed into a threaded recess of the lighter and able to compress the disk at its periphery, and a second central compression element slidably mounted inside the first and able to compress the permeable disk in its central part, characterized by said control element being mounted such as to slide between two positions, a presetting position wherein it is coupled rotationally with the annular compression element and does not compress the central part of the disk, and a setting position wherein it is decoupled from the annular compression element and exerts an axial compression force on the central compression element.

In the device according to the prevent invention, the two setting elements are hence independent of each other, access to each of them being possible without it being necessary to disassemble the other.

Moreover, by means of this device it is possible automatically to eliminate compression of the central part of the disk when compression of this annular part is adjusted by moving a control element. Hence, when the flame presetting operation is being performed (by compression of the annular part of the disk) one is certain of not disturbing it by compressing the center of the disk.

The rotational link between the setting control element and the annular compression element can be provided, for example, by means of lengthwise grooves of matching shapes provided on these parts.

In one version, the device according to the invention can be considerably simplified by making the setting control element and the central compression element in the form of a single part.

Figure 3:
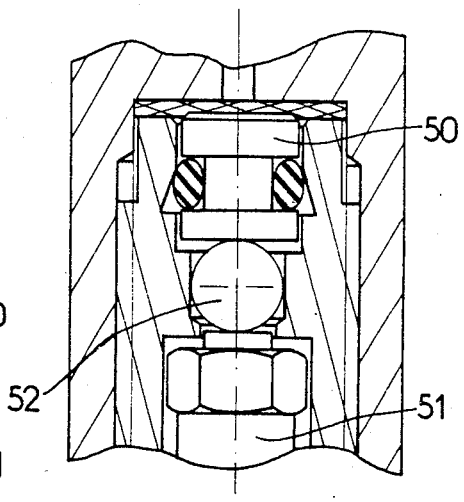
Figure 2:
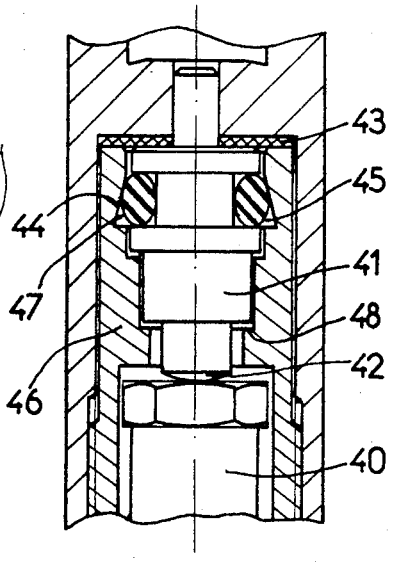
Figure 4:
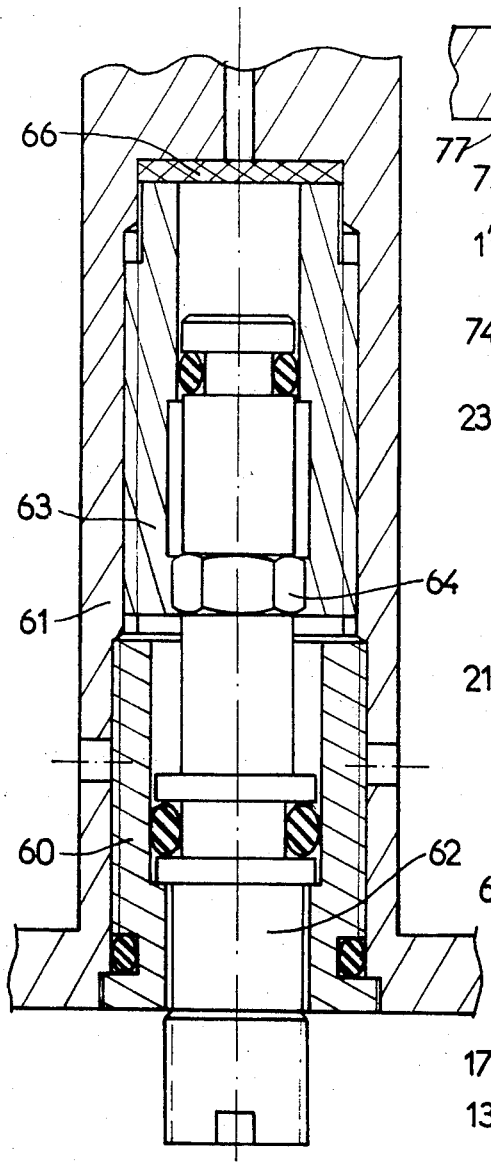
Figure 5:
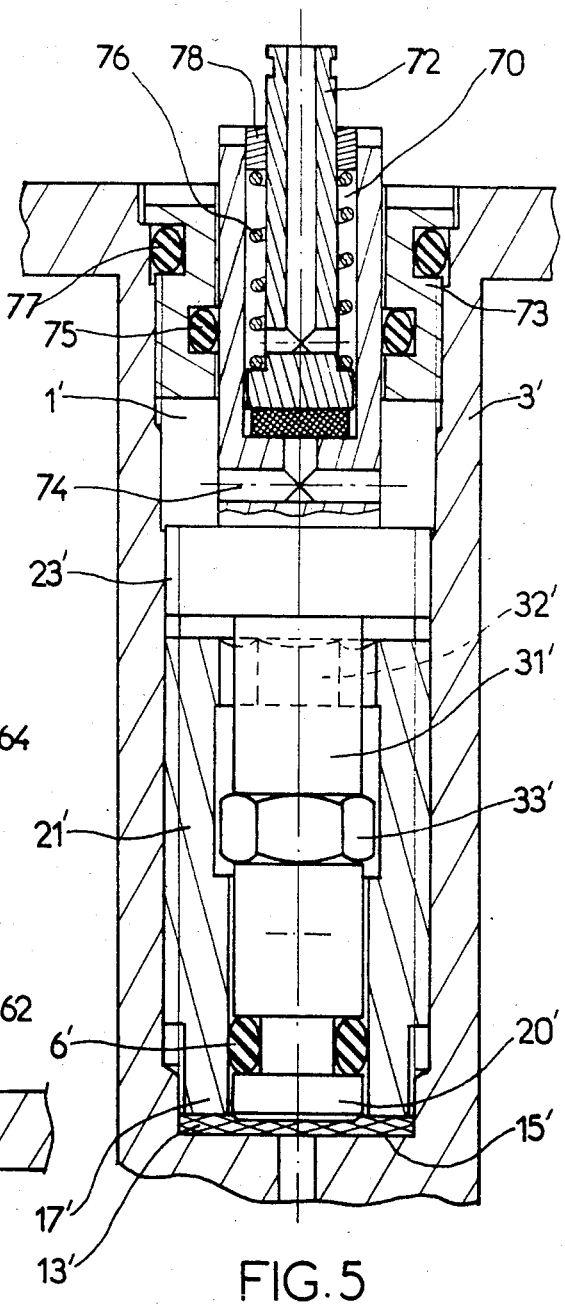

Several embodiments of the invention will be described hereinbelow with reference to the attached drawings, wherein:

FIG. 1 is a partial lengthwise section through a lighter equipped with a gas flowrate setting device according to the invention;

FIGS. 2, 3, and 4 represent, in cross section, versions of the embodiment represented in FIG. 1;

FIG. 5 is a partial lengthwise cross section of a lighter equipped with a second embodiment of a gas flowrate setting device according to the invention.

In the embodiment shown in FIG. 1, the gas flowrate setting system is disposed inside a cavity 1 of a tube 3 attached to the bottom 5 of the reservoir of a lighter. This cavity communicates with the lighter burner (not shown in the drawing) via a channel 11. The latter can be blocked by means of a check valve 9.

A permeable elastic disk 13 is compressed between the end 15 of cavity 1, on the one hand by an annular compression element 17 and, on the other hand, by a central compression element 20 which, in the present embodiment, is composed of the end of setting control element 31.

Annular compression element 17 is composed of a screw. The latter is screwed into a thread 21 of tube 3. It is provided axially with a cavity 22 designed to receive central compression element 20.

Setting control element 31 comprises principally a threaded crown 23 screwable into thread 21 of tube 3, a hexagonal part 33, rotationally couplable with a hexagonal recess 32 of screw 17, and central compression element 20. O-rings 4 and 6 respectively provide tightness between tube 3 and central compression element 20 on the one hand and between this central compression element and annular compression element 17 on the other hand.

This being the case, to adjust the lighter gas flowrate, one proceeds in two stages: a presetting stage, or stage of setting the maximum gas flowrate deliverable by the lighter, followed by a setting stage consisting of bringing the flowrate to its normal operating level.

To put the device into the presetting position, setting control element 31 is unscrewed until threaded crown 23 is completely free of thread 21. This causes central compression element 20 to be removed from disk 13, at the same time eliminating any possibility of influencing the preset flowrate by this element compressing the disk. Then, control element 31 is made to slide until its hexagonal part 33 becomes seated in hexagonal recess 32 of screw 17 such as to ensure rotational coupling of these two parts. Hence, any rotation of system 31 causes rotation of screw 17 and hence its lengthwise displacement, and enables compression of the annular part of disk 13 to be adjusted such as to obtain the gas flowrate corresponding to the desired maximum flame height.

To put the device in the setting position, control element 31 is pushed back to decouple it from screw 17, then screwed so that threaded crown 23 engages thread 21. Regulation of the flowrate corresponding to the desired operating flame height is then obtained by adjusting the compression of disk 13 by turning control element 31 to a greater or lesser degree.

As shown in FIGS. 2 and 3, the central compression element can be designed in several ways.

Thus, in FIG. 2, the compression transmitted by setting control element 40 is exerted on permeable elastic disk 43 by a central compression element 41 accommodated, as before, in a cavity of annular compression element 46. Element 41 is provided at its base with a hemispherical part 42 designed to minimize the rotational coupling with control element 40. This prevents disk 43 from being rotated during compression, so that it can be protected and its service life prolonged.

In addition, in this version, walls 44 of cavity 45 of annular compression element 46 are inclined. Thus, in addition to its sealing function, O-ring 47 plays the role of an elastic return means and removes central compression element 41 from disk 43 to apply it against end 48 of cavity 45 when it is no longer urged by control element 40.

In the version in FIG. 3, the rotational independence of central compression element 50 and of setting control element 51 is still further improved by interposition of a ball 52 between these two elements.

In the embodiment of FIG. 4, wherein the device is shown in the presetting position with permeable disk 66 urged only at its periphery, a ring 60 is interposed at the base of annular compression element 63, between the latter and control element 62. The upper part of this ring plays the role of a stop with respect to screw 63. Indeed, during the presetting phase and in the absence of this stop, screw 63, during a substantial downward axial movement, would escape hexagonal part 64. To reengage them it would then be necessary to disassemble the entire device. Ring 60, by preventing screw 63 from moving too far downward, remedies this drawback.

In FIG. 5, the gas flowrate setting device is disposed in a tube attached to the body of the lighter. This device is reversed with respect to that described in the embodiment of FIG. 1. Analogous elements are designated by the same numbers plus a prime (').

Central compression element 31' has a cavity 70 receiving a burner check valve 72. The latter both supplies the flame and blocks channel 74 providing communication between cavities 1' and 70. Burner check valve 72 is applied, in the blocking position, against the end of cavity 70 by a compression spring 76 which abuts both burner check valve and a stop 78 fastened to setting control element 31'. Tightness between the latter and the walls of cavity 1' is ensured by a ring 73 provided with two sealing O-rings 75 and 77.

The presetting and setting operations are performed as described above, with the aid of compression control system 31'.

We claim:

1. A system for setting the flowrate of a gas from a gas supply circuit of a burner of a liquified gas lighter, the gas supply including a cavity communicating with the burner, a permeable elastic disk disposed in the gas supply circuit of the burner, said permeable elastic disk arranged at an end shoulder portion of the cavity for compression by first and second compression means activated by a common control element, said first compression means comprising an annular element having a base, said annular element having a threaded portion on an outer surface thereof for screwing the annular element into a threaded portion of the cavity so as to compress an annular portion of the disk against said shoulder portion upon rotation of the annular element, said second compression means comprising a central compression element arranged within the annular element, said control element having a portion arranged for communication with the central compression element to compress central portions of the disk, said control element including means to engage the annular element, said control element having a threaded portion on an outer surface portion of the control element for screwing the control element into the cavity so that by turning the control element, the control element can be moved between a presetting and a setting position, so that in said presetting position, the central compression element is disengaged from the disk and the engaging means engage the annular element whereby the annular element can be rotated to compress only said annular portion of the disk, while in said setting position, the engaging means are decoupled from the annular element and the control element can exert an axial compressive force on the central compression element to thereby compress only central portions of the disk.

2. A device of claim 1 where the central compression element is an integral part of the control element.

3. A device of claim 1 where the central compression element is not an integral part of the control element and the central element includes a convex part arranged for communication with the control element to minimize rotational coupling between the central element and the control element when an axial compression force is exerted on the central element.

4. A device of claim 1, further including a ball arranged between the central compression element and the control element to minimize rotational coupling between the central and control elements when axial compression force is exerted on the central element.

5. A device of claim 1 where the inner walls of the annular element adjacent the central compression element are incurved in the direction of the compression element and a sealing ring is arranged in combination with the incurved walls and adapted to urge the compression element away from contact with the permeable elastic disk when axial compression force is not exerted on the central element.

6. A device of claim 1 further including a ring arranged between the base of the annular compression element and the control element to stop the extent of movement of the control element during adjustment of the control element to said presetting position.

* * * * *